United States Patent [19]

Grebow et al.

[11] 3,955,849

[45] May 11, 1976

[54] BEACH CHAIR

[76] Inventors: Mark Grebow; Janet Grebow, both of 3317 Lauri Road; Leonard E. Albert; Irma Albert, both of 8402 Carlson Lane, all of Baltimore, Md. 21207; Fred N. Ansel, 3926 Algiers Road, Randallstown, Md. 21133

[22] Filed: Dec. 13, 1974

[21] Appl. No.: 532,605

[52] U.S. Cl. ..... 297/183; 190/8; 248/156; 297/188; 297/217

[51] Int. Cl.[2] ..... A47C 4/52

[58] Field of Search ..... 190/8; 248/44, 156, 248/346; 297/45, 183, 188, 462, 463

[56] References Cited

UNITED STATES PATENTS

| | | | |
|---|---|---|---|
| 2,044,717 | 6/1936 | McElmoyl | 190/8 |
| 2,050,492 | 8/1936 | Lassiter | 297/183 X |
| 2,857,957 | 10/1958 | Gay | 248/156 X |
| 3,297,119 | 1/1967 | Viol | 190/8 |

*Primary Examiner*—James C. Mitchell
*Attorney, Agent, or Firm*—John B. Dickman, III

[57] ABSTRACT

A beach chair formed of a cylinder of canvas or other flexible material adapted to be filled with sand and having a cover flap to permit a person to sit thereon supported by the sand and protected by the flap. A pair of U-shaped rods inserted in the ground extend up along the side edges of the seat to support the seat and form lifting and carrying handles. Storage pockets are provided on the sides of the seat for accessories such as sunglasses, cigarettes, and the like. A net or mesh extends across the bottom of the chair to form an article holding beach bag and to allow the sand to escape when the chair is lifted.

1 Claim, 8 Drawing Figures

BEACH CHAIR

BACKGROUND OF THE INVENTION

Field of the Invention

The present invention relates to a combination portable knockdown beach chair tote bag and sand sifter utilizing sand as the supporting medium.

Summary of the Invention

A portable knockdown beach chair includes a cylindrical canvas band adapted to be placed on the beach and filled with sand. A flap is secured to the band and is adapted to extend across the sand filling the band to form a seat for the user. A back extends upwardly from the band and is supported by a pair of U-shaped rods extending into the sand below the band. A combined sand scoop and head rest is secured to the upper end of the back and storage pockets are secured to the chair for safely securing accessories.

The primary object of the invention is to provide a beach chair in which sand is used as a supporting medium and which can be folded and carried from place to place.

A further object of the invention is to provide a combined beach chair, sand sifter and tote bag.

Other objects and advantages will become apparent in the following specification when considered in the light of the attached drawings.

DESCRIPTION OF THE PREFERRED EMBODIMENT

Figure 1:
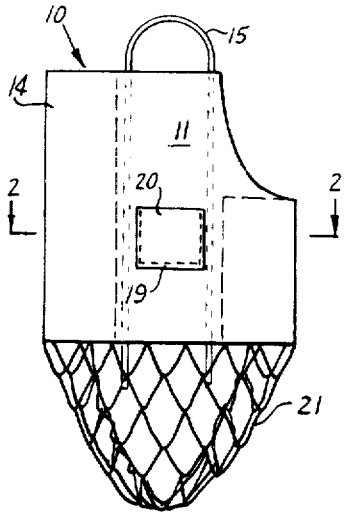
FIG. 1 is a side elevation of the device folded flat and showing fold lines for further folding.
Figure 3:
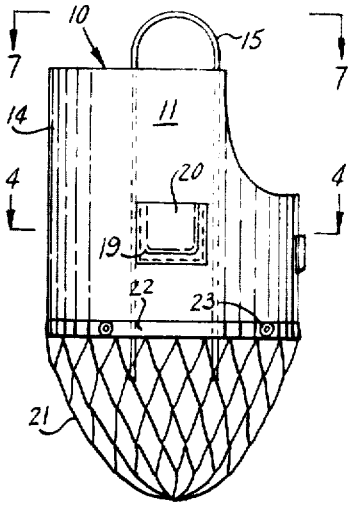
FIG. 3 is a side elevation of the device in its open position and ready to be filled with sand.
Figure 5:
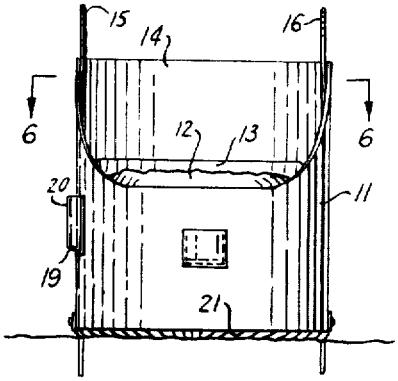
FIG. 5 is a front elevation of the device filled with sand and ready for use.

Referring now to the drawings in detail, wherein like reference characters indicate like parts throughout the several figures, the reference numeral 10 indicates generally a portable knockdown beach chair constructed in accordance with the invention.

The beach chair 10 includes a flexible canvas band 11 which is adapted to be filled with sand until nearly cylindrical while resting on the surface of a sand beach.

A generally circular canvas seat 12 is secured to the band 11 by means of a flap 13 so that the canvas seat 12 can be used to cover the sand in the band 11 to provide a seat for the user. An arcuate back 14 extends integrally upwardly from the band 11 and is aligned therewith. The back 14 and the band 11 have a pair of spaced, parallel U-shaped upright bars 15, 16 rigidly secured thereto and extending below the band 11 to permit them to be inserted in the sand to support the back 14 of the beach chair 10, the U-shaped portions extending above the back and used as handles for carrying.

A combined shovel and head rest 17 is secured to the upper end of the back 14 and is adapted to be filled with sand.

A pocket 19 is secured to the band 11 and has a closure flap 20 which is adapted to be releasably secured thereto in closing position.

Figure 2:
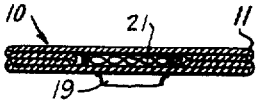
FIG. 2 is a vertical sectional view, taken along the line 2—2 of FIG. 1, looking in the direction of the arrows.
Figure 4:
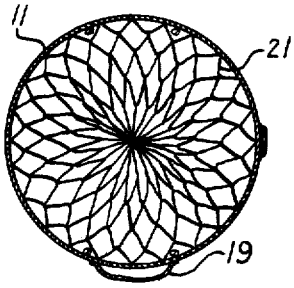
FIG. 4 is a top plan view of the device taken on the line 4—4 of FIG. 3.
Figure 6:
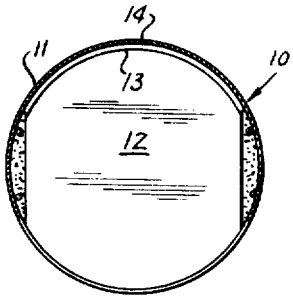
FIG. 6 is a top plan view of the device, taken on line 6—6 of FIG. 5, showing the seat flap in position for use.
Figure 8:
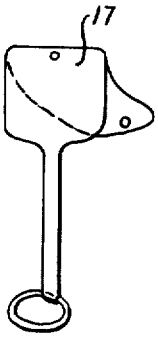
FIG. 8 shows a combination shovel and head rest.
Figure 7:
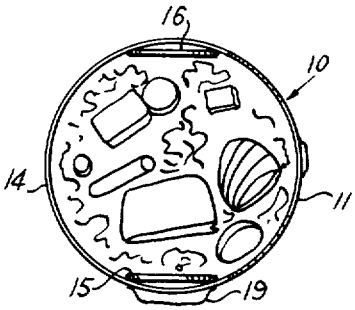
FIG. 7 is a top plan view taken on the line 7—7 of FIG. 3, showing the device used as a tote bag.

In the use and operation of the invention the beach chair 10 is carried in folded collapsed condition as illustrated in FIG. 2. On reaching a beach, the beach chair 10 is unfolded and the U-shaped bars 15, 16 are spread apart their maximum distance and inserted in the ground until the bottom edge of the band 11 comes in contact with the sand of the beach. The seat 12 is laid over the top of the back 14 leaving the band 11 open ready to be filled with sand. Sand is shoveled into the band 11 until it reaches the top edge thereof whereupon the seat 12 is positioned in contact with the top of the sand in the band 11. The head rest 17 is then filled with sand and the beach chair 10 is ready for use.

When ready to leave the beach the U-shaped bars 15, 16 are withdrawn from the sand by grasping the handles and lifting upwardly, the band 11 is thus pulled upwardly away from the sand, the sand then filters through the net 21, and the device can be folded for carrying. The net 21 can be permanently affixed to the band 11 or removably attached as by a band 22 carrying the snap fasteners 23.

While the band 11, seat 12, and back rest 14 have been disclosed as being formed of canvas, obviously any other flexible material having strength enough for the purpose may be substituted therefor, such as plastic, rubber, and heavy duty fabric.

Having thus described the preferred embodiment of the invention it should be understood that numerous structural modifications and adaptations may be resorted to without departing from the spirit of the invention.

We claim:

1. A portable, knockdown beach chair, capable of being rolled into a small bundle when not in use, comprising a flexible band, a flexible back rest secured to said band and extending integrally upwardly therefrom, a pair of upright U-shaped bars forming handle means secured to said band and said back rest and projecting below said band for insertion in the ground to support said band and back rest on the sides thereof, a removable net portion attached to the lower edge of said band, said flexible band being adapted to be filled with sand with said band in contact with the sand of a beach along its lower edge and the back rest extending upwardly therefrom, a seat panel secured to said band at one edge thereof and adapted for covering the sand filling said band to form a seat, and a head rest secured to the inner portion of the upper end of said back rest, said head rest comprising a pouch having a filling opening therein to permit said pouch to be filled with sand.

* * * * *